United States Patent [19]

Hattori et al.

[11] Patent Number: 4,714,291

[45] Date of Patent: Dec. 22, 1987

[54] LUMBAR SUPPORT

[75] Inventors: Takemi Hattori, Kariya; Nobuhiko Takeda, Oobu, both of Japan

[73] Assignee: Aisin Seiki Kabushiki Kaisha, Aichi, Japan

[21] Appl. No.: 28,403

[22] Filed: Mar. 20, 1987

[30] Foreign Application Priority Data

Mar. 31, 1986 [JP] Japan ..... 61-47822[U]

[51] Int. Cl.[4] ..... A47C 3/00

[52] U.S. Cl. ..... 297/284; 297/204; 297/460

[58] Field of Search ..... 297/284, 204, 300, 304, 297/305, 285, 460

[56] References Cited

U.S. PATENT DOCUMENTS

| | | | |
|---|---|---|---|
| 607,651 | 7/1898 | Blossom | 297/204 |
| 3,463,544 | 8/1969 | Froelich | 297/284 |

FOREIGN PATENT DOCUMENTS

| | | | |
|---|---|---|---|
| 2822766 | 12/1978 | Fed. Rep. of Germany | 297/284 |
| 0009226 | 1/1977 | Japan | 297/284 |
| 584756 | 1/1947 | United Kingdom | 297/284 |

*Primary Examiner*—James T. McCall

*Attorney, Agent, or Firm*—Finnegan, Henderson, Farabow, Garrett and Dunner

[57] ABSTRACT

A lumbar support includes a seat back body, a lumbar plate, and plate moving means for moving the lumbar plate back and forth. The plate moving means includes a base portion supported by the seat back body and having a pair of oblong holes, a screw rod supported for free rotation on the base portion and having a male screw on its outer surface, a nut member having a centrally formed female screw threadedly engaged with the male screw, the nut member being moved axially of the screw rod by turning the latter, an anchor member connecting the lumbar plate to the nut member and having a ring-shaped pivot portion at an end thereof on the side of the nut member, and a distance compensating pin passed through the ring-shaped pivot portion and supported at the oblong holes so as to be movable in the longitudinal direction of the oblong holes. When the nut member is moved axially of the screw rod, the distance compensating pin moves longitudinally of the oblong holes so as to compensate for a change in distance between the center of the ring-shaped pivot portions and the center of rotation of the screw rod.

3 Claims, 7 Drawing Figures

LUMBAR SUPPORT

BACKGROUND OF THE INVENTION

1. Field of the Invention

This invention relates to a lumbar support provided in the back of a seat.

2. Description of the Prior Art

An example of a conventional lumbar support provided in the back of a seat is disclosed in the specification of Japanese Patent Publication (KOKOKU) No. 57-19965. The disclosed lumbar support includes a seat back body, a resilient member supported by the seat back body, a lumbar plate one surface of which is abutted against the resilient member in such a manner that the resilient member is embraced by the lumbar plate and the seat back body, and plate moving means for moving the lumbar plate back and forth.

As shown in the sectional view of FIG. 1, the plate moving means comprises a base portion 41 supported by the seat back body; a screw rod 43 supported for free rotation on the base portion 41 and having a male screw provided on its outer peripheral surface; a handle 44 for turning the screw rod 43; a nut member 45 having a centrally formed female screw threadedly engaged with the male screw of the screw rod 43 and a pair of grooves 46 formed in its outer peripheral surface, the nut member 45 being moved longitudinally of the screw rod 43 by turning the latter; a torsion spring 49 having its one end connected to the approximate central portion of a lumbar plate 47 and having its other end fitted into the grooves 46, the base end portion of said other end having a ring-shape pivot portion 50; and a retaining pin 51 passed through the ring-shaped pivot portion 50 and having both ends retained in round holes 52 (only one of which is shown) provided in the base portion 41.

As shown in FIG. 2, the torsion spring 49 is fitted into the drum-shaped grooves 46 in the outer periphery of the nut member 45 with some play in the axial direction of the screw rod 43 so as to allow a change in the relative angle between the torsion spring 49 and the nut member 45. Further, the opposite surfaces of each groove 46 provided in the outer periphery of the nut member 45 is made arcuate in contour relative to a plane perpendicular to the axis of the screw rod 43 to reduce the amount of contact between the torsion spring 49 and the grooves 46 in such a manner that the change in the relative angle between the torsion spring 49 and nut member 45 may take place smoothly. In other words, the torsion spring 49 is provided with play along the axis of the screw rod 43. This play is essential for the purpose of moving the lumbar plate 47 to the desired position.

However, due to the play in the axial direction of the screw rod 43, the amount the handle 44 is turned and the amount the lumbar plate 47 is moved are not in one-to-one correspondence. This means that movement of the lumbar plate 47 exhibits poor reproducibility. Furthermore, since there is the play in the axis of the screw rod 43, the nut member 45 rotates together with the handle 44 for a short period of time when the handle 44 is turned, as shown in FIG. 3, and the nut member 45 does not move in the axial direction of the screw rod 43. Thus, the result again is lack of one-to-one correspondence between rotation of handle 44 and movement of lumbar plate 47.

Since there is no reproducibility between rotation of the handle 44 and movement of the lumbar plate 47, adjusting the position of the lumbar plate 47 is a complicated and troublesome task.

SUMMARY OF THE INVENTION

Accordingly, an object of the present invention is to provide a lumbar support with very little play and in which there is good reproducibility between operation of the handle and movement of the lumbar plate.

According to the present invention, the foregoing object is attained by providing a lumbar support comprising a seat back body, a resilient member supported by the seat back body, a lumbar plate one surface of which is abutted against the resilient member in such a manner that the resilient member is embraced by the lumbar plate and the seat back body, and plate moving means for moving the lumbar plate back and forth. The plate moving means comprises a base portion supported by the seat back body and having a pair of oblong holes; a screw rod supported for free rotation on the base portion and having a male screw provided on its outer peripheral surface; a nut member having a centrally formed female screw threadedly engaged with the male screw of the screw rod, the nut member being moved axially of the screw rod by turning the latter; a pair of anchor members connecting the lumbar plate to an outer circumferential surface of the nut member, each having a ring-shaped pivot portion at an end portion thereof on the side of the nut member; and a distance compensating pin passed through the ring-shaped pivot portions and supported at the oblong holes so as to be movable in the longitudinal direction of the oblong holes, wherein when the nut member is moved axially of the screw rod, the distance compensating pin moves in the longitudinal direction of the oblong holes so as to compensate for a change in distance between the center of the ring-shaped pivot portions and the center of rotation of the screw rod.

Thus, the lumbar support of the invention comprises the seat back body, the resilient member, the lumbar plate and the plate moving means. The plate moving means comprises the base portion, the screw rod, the nut member, the anchor members and the distance compensating pin.

A characterizing feature of the lumbar support of the invention is that one end of each of the anchor members is anchored in the nut member to eliminate play, and that the anchor members and the nut member are fixed to each other. A change in the distance between the center of the ring-shaped pivot portions and the center of screw rod rotation, which change is brought about when the nut member is moved axially of the screw rod, is compensated for owing to movement of the distance compensating pin longitudinally of the oblong holes in dependence upon the movement of the nut member.

In the operation of the lumbar support according to the invention, the nut member moves axially of the screw rod when the screw rod is turned. Since the anchor members are anchored in the nut member, these members move with the nut without play with respect to nut movement. At this time, an amount of change produced in a direction that turns the anchor members is compensated for by movement of the distance compensating pin, which is passed through the ring-shaped pivot portions of the anchor members. Thus, the nut member, anchor members and lumbar support move in unison without play. In other words, rotation of the screw rod moves the lumbar plate faithfully without play. This makes it possible to adjust the set position of the lumbar plate easily and with good reproducibility.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of a lumbar support according to the present invention will now be described with reference to FIGS. 4, 5 and 6. The invention may particularly be applied to a means for moving a lumber plate as used in the conventional lumbar support structure.

Figure 1:
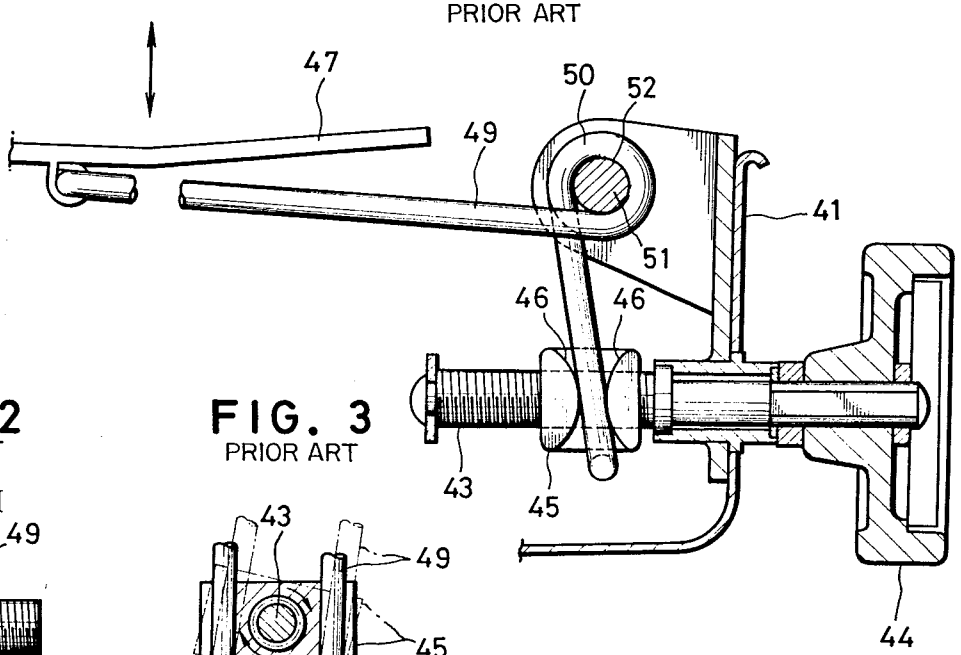
FIG. 1 PRIOR ART
FIG. 1 is a sectional view illustrating the principal portion of conventional lumbar support moving means.
Figure 3:
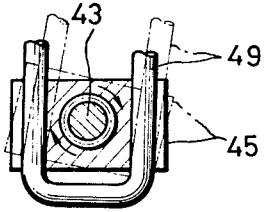
FIG. 3 PRIOR ART
FIG. 3 is a sectional view taken along a line of III—III in FIG. 2 and illustrating movement of a torsion spring.
Figure 2:
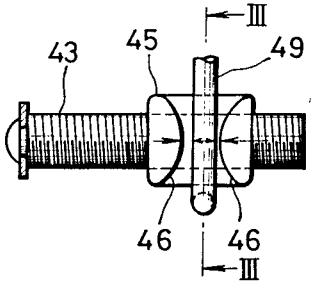
FIG. 2 PRIOR ART
FIG. 2 is a schematic view illustrating the principal portion of a nut member according to the prior art.
Figure 4:
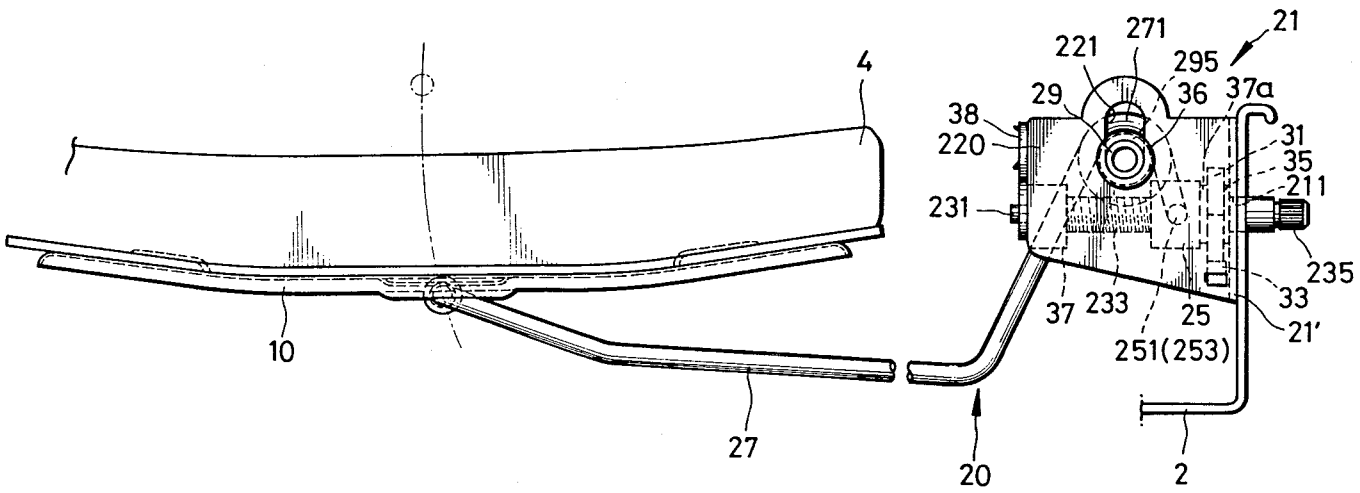
FIG. 4 is a plan view illustrating an embodiment of a lumbar support according to the present invention.

As shown in the plan view of FIG. 4, the lumbar support includes a resilient member 4 supported by a seat back body 2, a lumbar plate 10 one surface of which is abutted against the resilient member 4 in such a manner that the resilient member is embraced by the lumbar plate 10 and the seat back body 2, and plate moving means 20 for moving the lumbar plate 10 back and forth.

Figure 5:
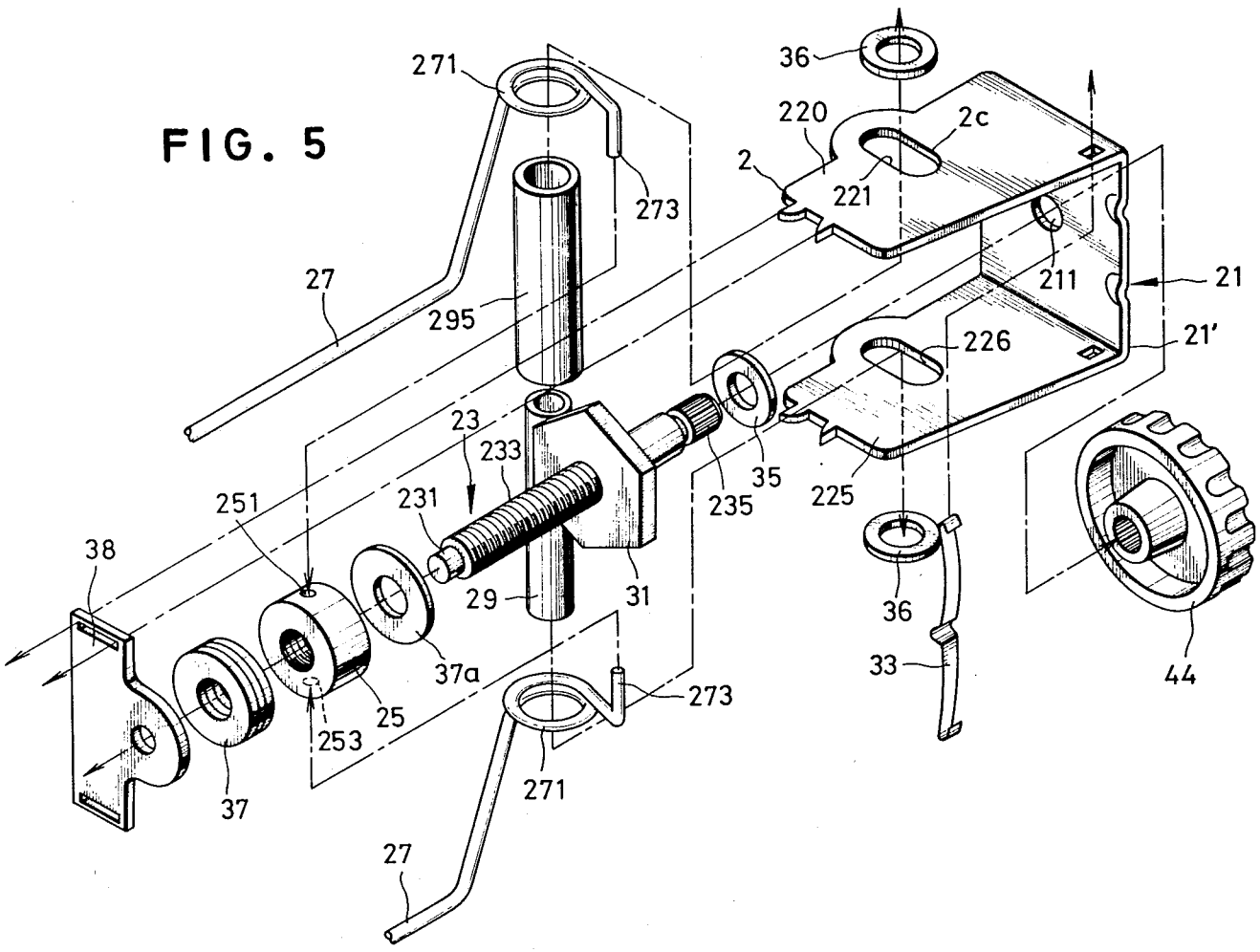
FIG. 5 is an exploded view showing each parts of the lumbar support of the illustrated embodiment.
Figure 6:
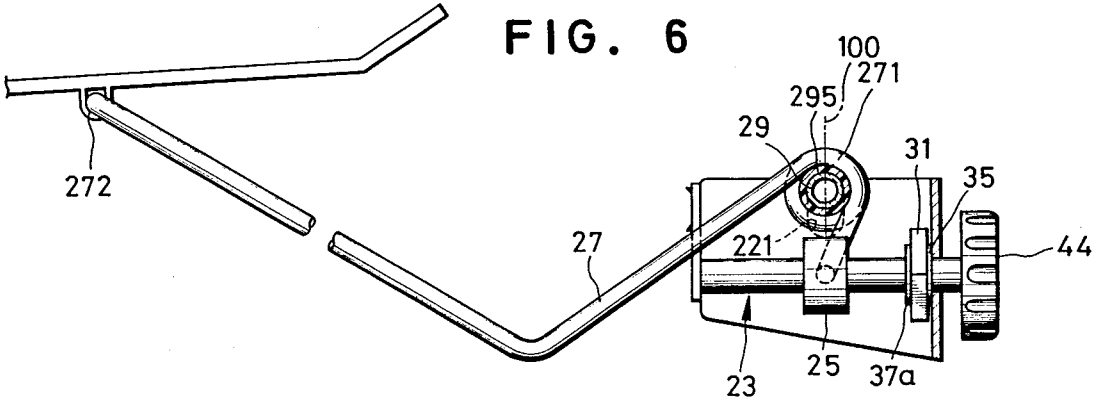
FIGS. 6 and 7 are schematic views each showing movement of the lumbar support of the illustrated embodiment.

As shown in the exploded view of FIG. 5, the plate moving means 20 includes a base portion 21, a screw rod 23, a nut member 25, anchor members 27 made of torsion springs and a distance compensating pin 29.

The base portion 21 comprises a bracket-shaped plate 21' formed by bending two opposing sides 220, 225 of the plate approximately 90 degrees in the same direction using a press. Formed in the center of the base portion 21 is a hole 211 through which the screw rod 23, described below, is passed. Formed in the side portions 220, 225 of the plate 21' are respective oblong or elongated holes 221, 226 the major axes whereof lie parallel to the bent corners of the plate. The oblong holes 221, 226 are provided opposite each other so that the distance compensating pin 29 can move smoothly along the major axes of these holes.

The screw rod 23 comprises an engaging portion 231 formed at one end thereof and having an outer diameter smaller than that of the threads, a male screw 233 formed at a central portion of the rod, and a spline shaft portion 235 formed at the other end thereof for being fitted into a spline boss provided at the center of the aforementioned handle 44 through the hole 211.

The nut member 25 is formed by cutting a round bar crosswise and includes a female screw formed at its center bore for threadedly engaging the male screw 233 of the screw rod 23. Formed in the outer circumferential portion of the nut member 25 so as to oppose each other across the center of the nut member are deep holes 251, 253. One end portions of the anchor members 27 are anchored in the holes 251, 253 so as to be freely rotatable.

Each of the anchor members 27 comprises a wire consisting of spring steel and shaped by press work. Each anchor member 27 includes a bent portion 272 (FIG. 6) at one end connected to the lumbar plate 10 so as to be freely rotatable, a bent portion 273 (FIG. 5) at the other end for being inserted into a corresponding one of the deep holes (either 251 or 253) formed in the nut member 25, and a ring-shaped pivot portion 271 formed near the bent portion 273.

The distance compensating pin 29 is obtained by cutting a thick-walled pipe crosswise and has an outer diameter slightly smaller than the width of the oblong holes 221, 226, and a length several millimeters greater than the distance between the side portions 220, 225 of the base portion 21. Inserted between the side portions 220, 225 is a pipe-shaped spacer 295 through which the pin 29 is passed. The spacer is made of a synthetic resin.

In order to provide the user with a handle-turning sensation, there is provided a handle notch portion comprising a rotary plate 31 having a hole at its center for mating with the shaft portion of the male screw as well as cut-outs at positions where the outer circumferential surface is equally divided into four or six parts, and a leaf spring 33 having projections which come into abutting contact with the cut-outs of the rotary plate 31.

The apparatus further includes washers 36 fitted over the end portions of the pin 29 projecting from the side portions 220, 225, a spacer 35 fitted over the screw rod 23 between the rotary plate 31 and the base portion 21, cushion members 37, 37a fitted over the screw rod 23 on both sides of the nut member 25, and a stopper plate 38 receiving the engaging portion 231 of the screw rod 23.

The foregoing component parts are assembled in the following manner to construct the lumbar support of the invention.

First, the rotary plate 31 is fixed to the screw rod 23, the spacer 35 is fitted over the end portion of the rod 23 near the rotary plate 51, and the nut member 25 is screwed onto the male screw 233 so as to be embraced by the cushion members 37, 37*a*. The spline portion 235 is then passed through the hole 211 in the base portion 21, and the engaging portion 231 is received by the stopper plate 38 on the nut member side in such a manner that the screw rod 23 may rotate freely. The handle 44 is securely attached to the spline portion 235 projecting from the hole 211 in base portion 21.

Next, the end portions 273 of the anchor members 27 are inserted into deep holes 251, 253 of the nut member 25, and the other end portions 272 of the anchor members 27 are connected to fastening portions (not shown) provided on the lumbar plate 10. The base portion 21 having the above elements thus attached thereto is then secured to the seat back body. This concludes the assembly of the lumbar support.

Figure 7:
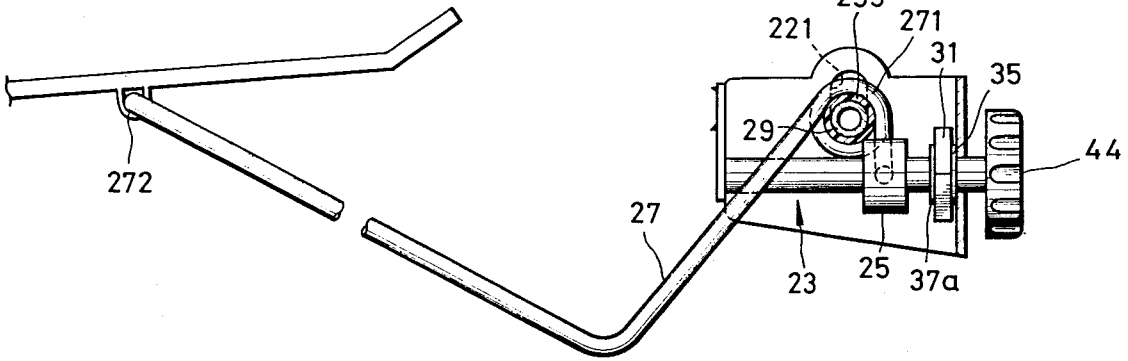

The operation of the assembled lumbar support will now be described with reference to FIG. 6. When the handle 44 is turned until the nut member 25 moves from the position indicated by FIG. 6 to the position indicated by FIG. 7, the distance compensating pin 29 moves to the position shown by FIG. 7. In FIGS. 6 and 7, the cushion member 37 is omitted.

Thus, the distance compensating pin 29 compensates for distance independence upon movement of the nut member 25.

In accordance with the illustrated embodiment, the plate moving means 20 in the lumbar support essentially comprises the base portion 21, screw rod 23, nut member 25, anchor members 27 and distance compensating pin 29, as illustrated in the exploded view of FIG. 5. The nut member 25 moves independence upon rotation of the screw rod 23, at which time a change in the rotating direction of the anchor members 27 secured to the nut member 25 is compensated for by movement of the distance compensating pin 29 along the major axis of the oblong holes 221, 226. Consequently, the amount of movement of the screw rod 23 and that of the lumbar plate 10 are in one-to-one correspondence. As a result, the lumbar plate can be set at a desired position easily and with good reproducibility.

By virtue of the construction of the plate moving means 20, the amount of screw rod rotation is transmitted to the lumbar plate 10 via the nut member 25 and the anchor members 27 integrated therewith. Since there is no play between the nut member 25 and the anchor members 27, the lumbar plate 10 is moved reliably by movement of the screw rod 23 without the play that occurs in the prior art. This enables the lumbar plate to be set to a desired position with ease and good reproducibility.

As many apparently widely different embodiments of the present invention can be made without departing from the spirit and scope thereof, it is to be understood that the invention is not limited to the specific embodiments thereof except as defined in the appended claims.

What we claim is

1. In a lumbar support comprising a seat back body, a resilient member supported by said seat back body, a lumbar plate one surface of which is abutted against said resilient member in such a manner that said resilient member is embraced by said lumbar plate and said seat back body, and plate moving means for moving said lumbar plate back and forth, an improvement wherein said plate moving means comprises:

a base portion supported by said seat back body and having a pair of opposing oblong holes;

a screw rod supported for free rotation on said base portion and having a male screw provided on its outer peripheral surface;

a nut member having a centrally formed female screw threadedly engaged with the male screw of said screw rod, said nut member being moved axially of said screw rod by turning the latter;

an anchor member connecting said lumbar plate to an outer circumferential surface of said nut member and having a ring-shaped pivot portion at an end portion thereof on the side of said nut member; and a distance compensating pin means having a pin passed through the ring-shaped pivot portion and supported at the oblong holes so as to be movable in the longitudinal direction of the oblong holes, wherein when said nut member is moved axially of said screw rod, the distance compensating pin moves in the longitudinal direction of the oblong holes so as to compensate for a change in distance between the center of the ring-shaped pivot portion and the center of rotation of said screw rod.

2. A lumber support according to claim 1 wherein said a distance compensating pin means includes a pipe-shaped spacer in which said pin is passed.

3. A lumber support according to claim 2 wherein said screw rod has a rotary plate into contact with a spring supported by said base portion.

* * * * *